United States Patent [19]

Møller

[11] 4,121,751

[45] * Oct. 24, 1978

[54] PACKING CARTON FOR BREAKABLE ARTICLES

[75] Inventor: Bent Møller, Vaerlose, Denmark

[73] Assignee: Aktieselskabet Brodrene Hartmann, Lyngby, Denmark

[ * ] Notice: The portion of the term of this patent subsequent to May 2, 1995, has been disclaimed.

[21] Appl. No.: 780,055

[22] Filed: Mar. 22, 1977

Related U.S. Application Data

[63] Continuation of Ser. No. 499,646, Aug. 22, 1974.

[30] Foreign Application Priority Data

Aug. 31, 1973 [DE] Fed. Rep. of Germany ..... 2344096

[51] Int. Cl.[2] ..... B65D 1/36

[52] U.S. Cl. ..... 229/2.5 EC

[58] Field of Search ..... 229/25, 2.5 EC, 44 EC, 229/45 EC, 29 M; 220/337

[56] References Cited

U.S. PATENT DOCUMENTS

| | | | |
|---|---|---|---|
| 3,469,763 | 9/1969 | Voohis | 229/2.5 |
| 3,519,189 | 7/1970 | Barnhard | 229/44 EC |
| 3,616,487 | 11/1971 | Dearth | 220/337 |
| 3,790,062 | 2/1974 | Boyd | 229/2.5 |
| 3,813,027 | 5/1974 | Misdom | 229/2.5 |

*Primary Examiner*—Herbert F. Ross

*Attorney, Agent, or Firm*—Pennie & Edmonds

[57] ABSTRACT

A packing carton for breakable articles, in particular eggs, consisting of a container member, a lid member hinged on the latter by means of an articular fold or hinge line, and a closing flap hinged on one of these members by means of an articular fold or hinge line which when the lid member is closed over the container member engages in the respective other member, its outside lying opposite the inside of one of the side walls of this member. At least one fastening projection is provided on the outside of the flap, and at least one fastening opening is provided in the relative side wall to accommodate the projection when the carton is closed. At least one of these articular folds or hinge lines, and preferably that which joins the container member to the lid member, has slot-shaped recesses or apertures which are oblong, running in the direction of the fold or hinge line, and are distributed at several positions over its length, wherein the spacing between the recesses or apertures is a multiple of the length of the same.

4 Claims, 3 Drawing Figures

PACKING CARTON FOR BREAKABLE ARTICLES

This is a continuation, of application Ser. No. 499,646 filed Aug. 22, 1974.

The present invention relates to a packing carton for breakable articles, in particular eggs, consisting of a container member, a lid member hinged on the latter by means of an articular fold or hinge line, and a closing flap hinged on one of these members by means of an articular fold or hinge line which when the lid member is closed over the container member engages in the respective other member, its outside lying opposite the inside of one of the side walls of this member, wherein at least one fastening projection is provided on the outside of the flap, and at least one fastening opening is provided in the relative side wall to accommodate the projection when the carton is closed.

When closing such a carton, problems may arise in practice from the articular folds or hinge lines being torn or ruptured on closing the carton. This is particularly applicable in the case where the carton is made of relatively brittle material, such as papier-mache.

It is the purpose of the present invention to solve this problem, and this is achieved in accordance with the invention in that at least one of these articular folds or hinge lines, and preferably that which joins the container member to the lid member, where the bending stress is frequently greatest, has slot-shaped recesses or apertures which are oblong running in the direction of the fold and are distributed at several positions over its length, wherein the spacing between the recesses or apertures is a multiple of the length of the same. It has been shown that in this manner the danger of the articular folds tearing or rupturing on mutually pivoting the carton members to close the carton can be met effectively without the durability of the articular joint between the members being impaired.

The recesses or apertures may, in accordance with the invention, be covered over by a projection of U-shaped cross-section protruding from the inside of the articular fold or hinge line, which on mutual pivoting of the carton members hinged together may serve as an aid to braking or damping the pivoting movement. By this means the danger of too strong an action on the articular fold or hinge line can be further avoided.

In accordance with the invention, the projection may be of smaller wall thickness at least in its middle section than the adjacent parts of the articular fold or hinge line. It is also advantageous according to the invention for a recess or an aperture to be provided at each end of the articular fold or hinge line.

The invention is explained in detail in the following with reference to the drawing.

Figure 1:
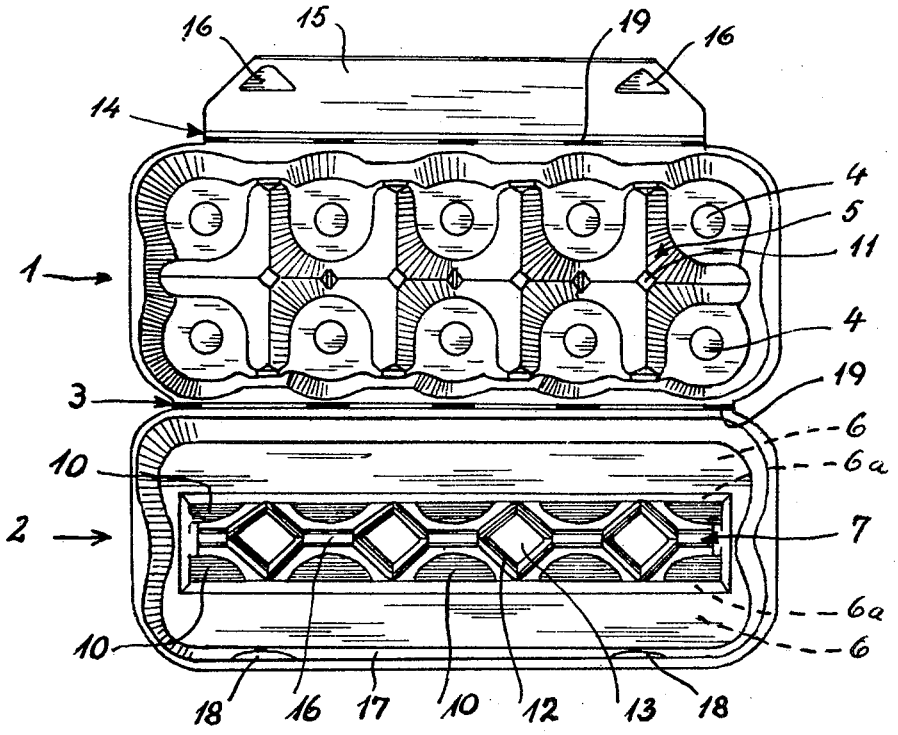
FIG. 1 shows, in the open state, the insides of an embodiment of a packing carton formed in accordance with the invention in the form of a speciment package.

The packing carton shown consists of a container member 1 and a lid member 2. The two members are joined together by an articular fold. The carton is designed for packing eggs.

The container member has two parallel rows of egg pockets 4, wherein five pockets 4 are placed in each row in the example illustrated. Disposed between the pockets placed adjacent each other in rows are protruberant supporting projections in the form of hollow pins 5, which define the pockets and act as supports for the lid member 2 when it is closed over the container member.

The lid member has two parallel, protruberant gable members 6 which extend parallel to the rows of pockets and lie above these rows when the package is closed. Extending between the gable members is a sunken lid section 7 which joins together the lower edges of the facing sides **6*a* of the gable members. 10 indicates a number of inspection holes for the eggs. These holes are formed partly in the sides 6*a* of the gable members, and partly in the lid section 7. The number of holes 10 corresponds to the number of pockets 4, and they are disposed so as to lie opposite the pockets 4 when the package is closed. In the present example there are therefore five holes 10 in each gable member 6**.

The dimensions of the package are such that when the package is closed, the upper section of the gable members 6 is higher, and the lid section 7 lower than the upper section of the eggs placed in the package, and such that the gable members 6 are narrower than the said part of the eggs.

Consequently a part of the eggs is visible in the holes 10 when the package is closed, and may project a bit through the holes, even so far as to come into contact with the edges of them and be held thereby.

The supporting projections 5 have a bearing surface 11 at their upper end.

Between the gable members 6, the lid member 2 is provided with counter-projections 12 with contact surfaces designed to rest on the surfaces 11, indicated by 13. In the example shown, the counter-projections 12 are formed as part of the sunken lid section 7.

When the package is closed, the front surfaces of the projections 5 and 12 are adjacent to one another.

A closing flap 15 is hinged on the container member 1 by means of an articular fold or hinge line 14. This flap has two projections 16 on its outside. When the carton is closed, the closing flap 15 is introduced into the lid member 2 and lies in it along the front inner wall 17 of the same. Fastening openings 18 corresponding to the two projections are provided in the inner wall, through which the projections 16 project when the package is closed, thereby holding the lid member 2 securely over the container member 1.

In the embodiment illustrated, oblong, slot-shaped recesses or apertures 20 running in the direction of the fold or hinge line are provided in both articular folds 3 and 14, the spacing between the recesses or apertures being a multiple of the length of the same. In the embodiment shown, the recesses or apertures are covered over by a projection of U-shaped cross-section protruding from the inside of the articular fold or hinge line.

Figure 2:
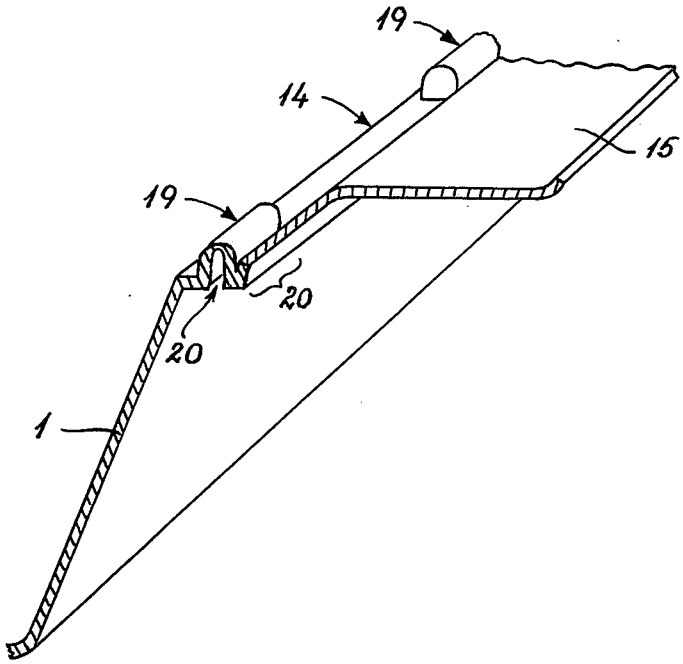
FIG. 2 is a view on a larger scale of a cross-section through an articular fold of the carton in the region of a projection in the fold provided in accordance with the invention.

FIG. 2 shows such a recess of aperture with a projection in the articular fold or hinge line 14 between the container member 1 and the closing flap 15. The recess of aperture, and thus also the projection, are obling in the direction of the articular fold or hinge line, and the projection is of U-shaped cross-section such that the free ends of the U are joined to the articular fold or hinge line. As a result an interruption in the fold or hinge line join is formed in the region limited by the free ends of the U. FIG. 1 shows a series of these projections 19 covering these recesses or apertures, uniformly distributed along the articular folds 3 and 14, wherein in each case a projection is provided at the respective end of the fold. The projection 19 may be of smaller wall thickness at least in their middle section than the adjacent parts of the articular fold, and if desired may even be more or less open.

Figure 3:
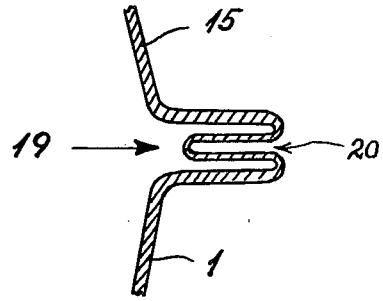
FIG. 3 is a cross-section through an articular fold in the region of a projection, in which the fold is folded together.

When pivoting the closing flap over the container member 1, as shown in FIG. 3 the projection 19 is wedged in between the the adjacent parts, and thus acts as a barrier against further pivoting.

Naturally the recesses or apertures proposed in accordance with the invention can be used, with the same or similar advantages to those explained, in other packages than the type shown by way of example.

I claim:

1. A packing carton for breakable articles such as eggs comprising a container member, a lid member, and a closing flap; said members and flap being screen molded from pulp as a unit to provide said container; a hinge line securing said lid member to said container member; a hinge line securing said closing flap to one of said members; said flap, when said lid member is in closed position on said container member, engaging the other of said members; the outside surface of said flap in said closed position lying against the inside surface of one side wall of said other member; at least one fastener projection projecting outwardly from the outside surface of said flap; at least one cooperating fastener opening in said side wall of said other member; said projection, when said flap is in said closed position, being engaged in said fastener opening to maintain the carton closed; one of said hinge lines having a plurality of slot-shaped elongated blind apertures spaced along the length thereof; the distance between adjacent apertures being greater than the length of an aperture; said one hinge line terminating at each of its ends in one of said plurality of slot-shaped blind apertures; said blind apertures each extending inwardly from the outer surface of said carton; each of said blind apertures presenting, on the inner side of said carton, its blind end in the form of projections extending inwardly along said hinge line; said projections being substantially "U" shaped in cross-section and substantially completely within said hinge line; and the interior of said carton being free of any other projections for cooperation with said first named projections.

2. A packing carton according to claim 1 in which both of said hinge lines have slot-shaped elongated apertures spaced along the length thereof; the distance between all adjacent apertures being greater than the length of an aperture; and in which both of said hinge lines terminate at each of their ends in one of said plurality of slot-shaped apertures.

3. A packing carton according to claim 1 in which said hinge line having said apertures is the hinge line that joins the container member to the lid member.

4. A packing carton according to claim 1 in which said projections have a lesser wall thickness in the bight of said U than the free ends thereof.

* * * * *